US009140486B2

(12) United States Patent
Wimbert et al.

(10) Patent No.: US 9,140,486 B2
(45) Date of Patent: Sep. 22, 2015

(54) DEVICE FOR DISPLAYING THE TEMPERATURE OF A REFRIGERATOR

(75) Inventors: Frank Wimbert, Owen (DE); Philip Hupfer, Esslingen (DE)

(73) Assignee: Flextronics AP, LLC, Broomfield, CO (US)

( * ) Notice: Subject to any disclaimer, the term of this patent is extended or adjusted under 35 U.S.C. 154(b) by 601 days.

(21) Appl. No.: 13/445,800

(22) Filed: Apr. 12, 2012

(65) Prior Publication Data

US 2012/0260684 A1 Oct. 18, 2012

(51) Int. Cl.
*F25D 27/00* (2006.01)

(52) U.S. Cl.
CPC ..... *F25D 27/00* (2013.01); *F25D 27/005* (2013.01); *F25D 2327/001* (2013.01); *F25D 2400/36* (2013.01); *F25D 2700/123* (2013.01)

(58) Field of Classification Search
CPC ... F25D 27/00; F25D 27/005; F25D 2327/00; F25D 2327/001; F25D 2700/123; F25D 2400/36
USPC ..... 62/129, 264; 362/92, 94
See application file for complete search history.

(56) References Cited

U.S. PATENT DOCUMENTS

| | | | | |
|---|---|---|---|---|
| 4,729,076 | A | 3/1988 | Masami et al. | |
| 5,632,551 | A | 5/1997 | Roney et al. | |
| RE36,414 | E | 11/1999 | Tickner | |
| 6,882,111 | B2 | 4/2005 | Kan et al. | |
| 7,259,403 | B2 | 8/2007 | Shimizu et al. | |
| 7,611,261 | B2 | 11/2009 | Richmond et al. | |
| 8,033,716 | B1 * | 10/2011 | Tandy et al. | 374/131 |
| 8,227,269 | B2 | 7/2012 | Chen et al. | |
| 8,228,261 | B2 | 7/2012 | Callegari et al. | |
| D687,179 | S | 7/2013 | Kim | |
| 8,591,051 | B2 | 11/2013 | Nakajima et al. | |
| 8,661,660 | B2 | 3/2014 | Ter-Hovhannissian | |
| 2001/0042865 | A1 | 11/2001 | Oshio et al. | |
| 2004/0062031 | A1 * | 4/2004 | Pinter | 362/31 |
| 2006/0186430 | A1 | 8/2006 | Park et al. | |
| 2008/0048200 | A1 | 2/2008 | Mueller et al. | |
| 2009/0179207 | A1 | 7/2009 | Chitnis et al. | |
| 2009/0272136 | A1 * | 11/2009 | Knoll et al. | 62/251 |
| 2010/0295070 | A1 | 11/2010 | Su et al. | |
| 2010/0295077 | A1 | 11/2010 | Melman | |
| 2011/0018017 | A1 | 1/2011 | Bierhuizen et al. | |
| 2011/0051413 | A1 | 3/2011 | Hand | |
| 2011/0085336 | A1 | 4/2011 | Blumel et al. | |

(Continued)

FOREIGN PATENT DOCUMENTS

| | | |
|---|---|---|
| DE | 102009034841 | 2/2011 |
| WO | WO 2011093614 A2 * | 8/2011 |

OTHER PUBLICATIONS

DE 202007013346 (English Translation).*

(Continued)

*Primary Examiner* — Jonathan Bradford
(74) *Attorney, Agent, or Firm* — Haverstock & Owens LLP

(57) ABSTRACT

A device for displaying the temperature of a refrigerator, having at least one temperature sensor (7) situated in the cooled interior (2) of the refrigerator (1), and having a temperature display for displaying the temperature measured by the temperature sensor (7), characterized in that the temperature display is formed by at least one refrigerator light (10) which has various colors, and which displays a different color depending on the measured temperature.

20 Claims, 1 Drawing Sheet

(56) References Cited

U.S. PATENT DOCUMENTS

| | | | |
|---|---|---|---|
| 2012/0097985 | A1 | 4/2012 | Liu et al. |
| 2012/0120667 | A1 | 5/2012 | Schenkl |
| 2012/0205697 | A1 | 8/2012 | Kim et al. |
| 2013/0027906 | A1 | 1/2013 | Ueda et al. |
| 2013/0050998 | A1 | 2/2013 | Chu et al. |
| 2013/0051001 | A1 | 2/2013 | Muskin |
| 2013/0135866 | A1 | 5/2013 | Souvay et al. |
| 2013/0155674 | A1 | 6/2013 | Park et al. |
| 2013/0182425 | A1 | 7/2013 | Seki et al. |
| 2014/0043810 | A1 | 2/2014 | Jo et al. |

OTHER PUBLICATIONS

DE 202007013346 (English Translation)—Published Jan. 3, 2008.*
Office Action dated Dec. 27, 2012, U.S. Appl. No. 12/252,881, filed Oct. 16, 2008, Applicant: Mark R. Callegari, 12 pages.

* cited by examiner

DEVICE FOR DISPLAYING THE TEMPERATURE OF A REFRIGERATOR

CROSS-REFERENCE TO RELATED APPLICATIONS

This application claims priority to German Patent Application No. 20 2011 000856.8, filed Apr. 13, 2011 and entitled "Anzeigevorrichtung für die Kühlschranktemperatur," which is hereby incorporated by reference in its entirety as if set forth herein.

FIELD OF THE INVENTION

The present invention relates to a device for displaying the temperature of a refrigerator, having at least one temperature sensor situated in the interior of the refrigerator, and having a temperature display for displaying the temperature measured by the temperature sensor.

BACKGROUND OF THE INVENTION

Nowadays, the temperature prevailing in a refrigerator is usually displayed via a digital display which is visible when the refrigerator door is open. If the actual temperature measured in the refrigerator deviates from a set target temperature, it notifies the user by sound. Since the cooling temperature decreases from the bottom cooling compartments toward the top cooling compartments of the refrigerator, a temperature display for each of the cooling compartments would be desirable, but this is not possible with the known digital display.

SUMMARY OF THE INVENTION

In contrast, for a temperature display device of the abovementioned type, the object of the present invention is to display to the user the particular measured temperature or a deviation from a set target cooling temperature in another manner.

This object is achieved according to the invention in that the temperature display is formed by at least one refrigerator light which has various colors, and which displays a different color depending on the measured temperature.

In contrast to the previous sound notification of a temperature exceedance, the temperature display according to the invention allows a continuous display, and also provides additional information. For example, in the case of a measured temperature that is too high, i.e., for a positive temperature deviation from a set target temperature, the refrigerator light can emit a red light, and in the case of a measured temperature that is too low, i.e., for a negative temperature deviation, the refrigerator light can emit a blue light, and if no temperature deviation is present, the refrigerator light can emit a white light. The degree of the deviation can also be displayed via the light intensity.

The at least one refrigerator light is particularly preferably formed by one or more RGB LEDs which is/are activated to display a different color depending on the measured temperature. The RGB LEDs are proportionately energized depending on the temperature, for example in order to emit light with a high blue component in the case of a negative temperature deviation, and to emit light with a high red component in the case of a positive temperature deviation.

In one preferred embodiment of the invention, the at least one refrigerator light is situated for coupling its light into a light-conducting refrigerator shelf, in particular at the rear or side end face of the refrigerator shelf, so that the refrigerator shelf lights up in a color that corresponds to the measured temperature.

In one aspect of the present invention, a device for displaying the temperature of a refrigerator comprises: at least one temperature sensor situated in the cooled interior of the refrigerator; and a temperature display for displaying the temperature measured by the temperature sensor, characterized in that the temperature display is formed by at least one refrigerator light which has various colors, and which displays a different color depending on the measured temperature. In some embodiments, the at least one refrigerator light is formed by at least one RGB LED which is activated to display a different color depending on the measured temperature. In some embodiments, the at least one refrigerator light is formed by multiple single-color LEDs whose colors differ from one another, and which are activated, individually or in combination, to display a different color depending on the measured temperature. In some embodiments, the at least one refrigerator light is situated in the cooled interior of the refrigerator, on the inside of the refrigerator door, or on the body of the refrigerator. In some embodiments, the temperature display is formed by multiple refrigerator lights, having various colors, which are each associated with different cooling compartments of the refrigerator, the refrigerator lights displaying a different color depending on the temperature measured in their respective cooling compartment. In some embodiments, the at least one refrigerator light is situated for coupling its light into a light-conducting refrigerator shelf, in particular at the rear or side end face of the light-conducting refrigerator shelf. In some embodiments, the refrigerator shelf has structures at its top, bottom, or front end face for decoupling the light that is coupled into the refrigerator shelf. In some embodiments, the light from the at least one refrigerator light is conducted to the outside, in particular via a fiber-optic light guide, from the closed refrigerator for an exterior display. In some embodiments, the at least one refrigerator light is provided on the outside of the refrigerator. In some embodiments, the at least one temperature sensor and/or a control electronics system is/are situated on a printed circuit board bearing the at least one LED. In some embodiments, the colors of light displayed in each case depending on the measured temperature are freely presettable by the user.

Advantageous embodiments of the invention are the subject matter of the subclaims. Further advantages of the invention result from the description and the drawings. In addition, the features mentioned above and explained in greater detail below can each be used individually, or collectively in any given combinations. The illustrated and described embodiments are not to be construed as an exhaustive list, but, rather, as an example for the description of the invention.

DETAILED DESCRIPTION

The following description is presented to enable one of ordinary skill in the art to make and use the invention and is provided in the context of a patent application and its requirements. Various modifications to the described embodiments will be readily apparent to those skilled in the art and the generic principles herein can be applied to other embodiments. Thus, the present invention is not intended to be limited to the embodiment shown, but is to be accorded the widest scope consistent with the principles and features described herein.

Figure 1:
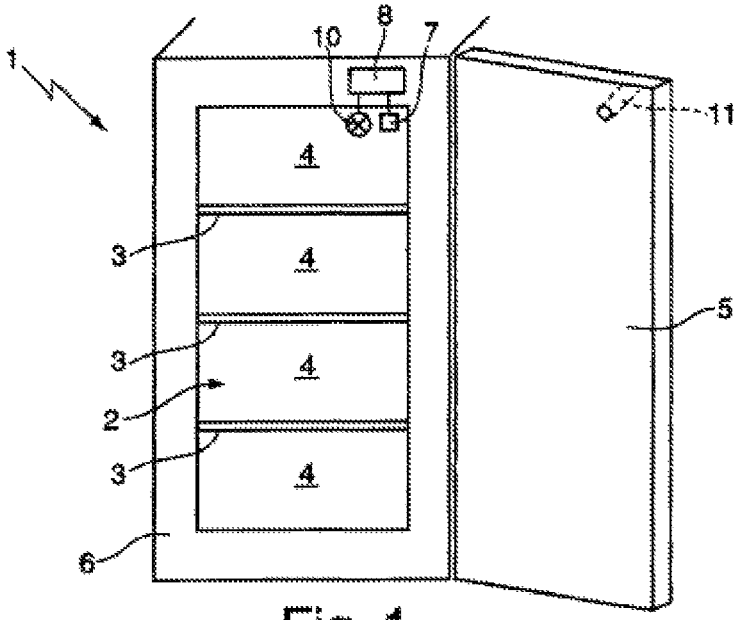
FIG. 1 shows a refrigerator having the temperature display according to the invention.

The refrigerator 1 shown in FIG. 1 has a cooled interior 2, which is divided into multiple cooling compartments 4 by multiple shelves 3, drawers, or inserts (not shown). A refrigerator door 5 closes off the cooled interior 2, and is connected to the body 6 of the refrigerator by hinges. The refrigerator temperature prevailing in the cooled interior 2 is detected by a temperature sensor 7 and relayed to a control unit 8, which in turn controls a temperature display. This temperature display is formed by a refrigerator light 10 having various colors, and which displays a different color depending on the measured temperature. The refrigerator light 10 can be dimmed in a time-delayed manner after the refrigerator 1 is opened so that the evaluation of the cooled products is not affected.

As shown in FIG. 1, the refrigerator light 10 can be formed by one or more RGB LEDs which are activated to display a different color depending on the measured temperature. The RGB LEDs are proportionately energized depending on the temperature, for example for emitting light with a high blue component in order to display lower temperatures, and for emitting light with a high red component to display higher temperatures. In this way, by using blue and red light it is possible to display a negative or positive temperature deviation with respect to a set target temperature, and via the color of light to display the degree of the deviation, to the user in a continuous manner, whereas white light is emitted when no temperature deviation is present. The colors of light displayed in each case depending on the measured temperature can be preset by the user as desired.

Alternatively, instead of being formed by one or more RGB LEDs, the refrigerator light 10 can be formed by multiple single-color LEDs whose colors differ from one another, and which are activated, individually or in combination, to display different colors depending on the measured temperature.

Instead of being situated in the cooled interior 2 of the refrigerator 1 as shown in FIG. 1, the refrigerator light 10 can alternatively be situated on the refrigerator door 5 or on the body 6 of the refrigerator.

For an exterior display when the refrigerator 1 is closed, the light from the refrigerator light 10 can be conducted to the outside via a fiber-optic light guide 11 located in the refrigerator door 5.

Figure 2:
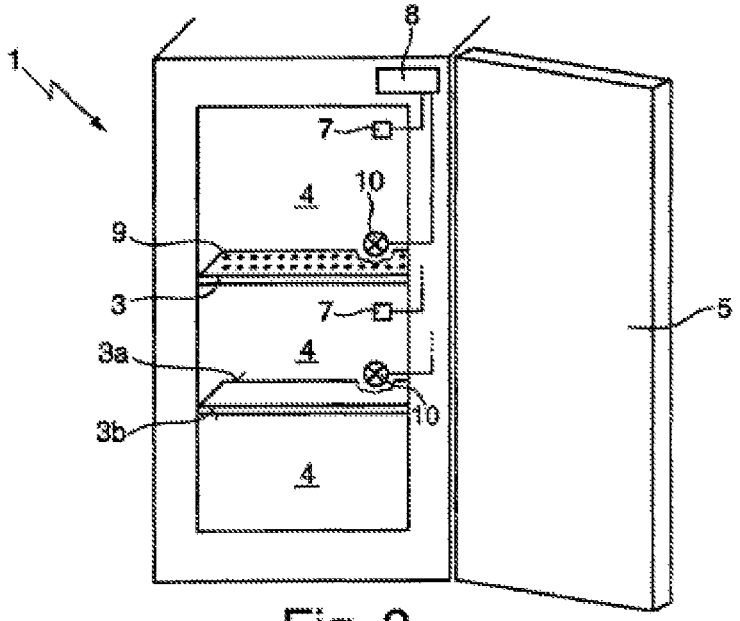
FIG. 2 shows a refrigerator having another temperature display according to the invention.

FIG. 2 shows another temperature display that is formed by multiple refrigerator lights 10, having various colors, which are each associated with different cooling compartments 4 of the refrigerator 1. Each cooling compartment 4 is assigned its own temperature sensor 7 which in each case is connected to the central control unit 8. Depending on the cooling temperatures measured in each case in the cooling compartments 4, each of the refrigerator lights 10 is activated by the control unit 9 to display a correspondingly different color in order to appropriately light up the cooling compartments 4 in color. The refrigerator lights 10, i.e., RGB LEDs, for example, are situated for coupling their light into the light-conducting shelf 3, in each case at the rear or side end face 3*a* of the shelf 3. The shelves 3 have structures 9 at their top, bottom, or front end face 3*b* in order to decouple the light that is coupled into the shelf 3, and to provide a display to the user.

Alternatively or additionally, the refrigerator light 10 can be provided on the outside of the refrigerator 1. In a departure from the embodiments shown, the temperature sensor 7 and the control electronics system 8 can be situated on a printed circuit board (not shown) bearing the LED.

The present invention has been described in terms of specific embodiments incorporating details to facilitate the understanding of principles of construction and operation of the invention. Such reference herein to specific embodiments and details thereof is not intended to limit the scope of the claims appended hereto. It will be readily apparent to one skilled in the art that other various modifications can be made in the embodiment chosen for illustration without departing from the spirit and scope of the invention as defined by the claims.

What is claimed is:

1. A device for displaying the temperature of a refrigerator, comprising:

at least one temperature sensor (7) situated in the cooled interior (2) of the refrigerator (1); and a temperature display for displaying the temperature measured by the temperature sensor (7), characterized in that the temperature display is formed by an at least one refrigerator light (10) which has various colors, and which displays a different color depending on the measured temperature, wherein the light from the at least one refrigerator light inside the refrigerator is conducted via a fiber-optic light guide to the outside from the closed refrigerator for an exterior display, wherein the fiber-optic light guide extends through one side of a door of the refrigerator to an opposite side of the door.

2. The temperature display device according to claim 1, characterized in that the at least one refrigerator light (10) is formed by at least one RGB LED which is activated to display a different color depending on the measured temperature.

3. The temperature display device according to claim 1, characterized in that the at least one refrigerator light (10) is formed by multiple single-color LEDs whose colors differ from one another, and which are activated to display a different color depending on the measured temperature.

4. The temperature display device according to claim 3, characterized in that the multiple single-color LEDs are activated individually to display a different color depending on the measured temperature.

5. The temperature display device according to claim 3, characterized in that the multiple single-color LEDs are activated in combination to display a different color depending on the measured temperature.

6. The temperature display device according to claim 1, characterized in that the at least one refrigerator light (10) is situated in the cooled interior (2) of the refrigerator (1).

7. The temperature display device according to claim 1, characterized in that the at least one refrigerator light (10) is situated on the inside of the refrigerator door (5).

8. The temperature display device according to claim 1, characterized in that the at least one refrigerator light (10) is situated on the body (6) of the refrigerator.

9. The temperature display device according to claim 1, characterized in that the temperature display is formed by multiple refrigerator lights (10), having various colors, which are each associated with different cooling compartments (4) of the refrigerator (1), the refrigerator lights (10) displaying a different color depending on the temperature measured in their respective cooling compartment (4).

10. The temperature display device according to claim 1, characterized in that the at least one refrigerator light (10) is situated for coupling its light into a light-conducting refrigerator shelf (3).

11. The temperature display device according to claim 10, characterized in that the at least one refrigerator light (10) is situated for coupling its light at a rear end face (3*a*) of the light-conducting refrigerator shelf (3), wherein the rear end face is a side opposite a door.

12. The temperature display device according to claim 10, characterized in that the at least one refrigerator light (10) is situated for coupling its light at a side end face (3*a*) of the light-conducting refrigerator shelf (3), wherein the side end face is a side between a door and a rear end face opposite to the door.

13. The temperature display device according to claim 10, characterized in that the refrigerator shelf (3) has structures (9) at its top end face (3*b*) allowing accessing and decoupling the light that is coupled into the refrigerator shelf (3).

14. The temperature display device according to claim 10, characterized in that the refrigerator shelf (3) has structures (9) at its bottom end face (3*b*) allowing accessing and decoupling the light that is coupled into the refrigerator shelf (3).

15. The temperature display device according to claim 10, characterized in that the refrigerator shelf (3) has structures (9) at its front end face (3*b*) allowing accessing and decoupling the light that is coupled into the refrigerator shelf (3).

16. The temperature display device according to claim 1, characterized in that an at least one second refrigerator light is provided on the outside of the refrigerator (1).

17. The temperature display device according to claim 1, characterized in that the at least one temperature sensor (7) is situated on a printed circuit board bearing the at least one LED.

18. The temperature display device according to claim 1, characterized in that a control electronics system (8) is situated on a printed circuit board bearing the at least one LED.

19. The temperature display device according to claim 1, characterized in that the at least one temperature sensor (7) and a control electronics system (8) are situated on a printed circuit board bearing the at least one LED.

20. The temperature display device according to claim 1, characterized in that the colors of light displayed in each case depending on the measured temperature are freely presettable by the user.

* * * * *